US010920368B2

(12) United States Patent
Antoinette et al.

(10) Patent No.: US 10,920,368 B2
(45) Date of Patent: Feb. 16, 2021

(54) SYSTEMS AND METHODS FOR COLORING NANOFIBROUS MATERIALS

(71) Applicant: Nanocomp Technologies, Inc., Merrimack, NH (US)

(72) Inventors: Peter L. Antoinette, Nashua, NH (US); Mark A. Banash, Bedford, NH (US); Ashley Hart, Manchester, NH (US)

(73) Assignee: Nanocomp Technologies, Inc., The Woodlands, TX (US)

( * ) Notice: Subject to any disclaimer, the term of this patent is extended or adjusted under 35 U.S.C. 154(b) by 715 days.

(21) Appl. No.: 15/440,213

(22) Filed: Feb. 23, 2017

(65) Prior Publication Data

US 2017/0241071 A1 Aug. 24, 2017

Related U.S. Application Data

(60) Provisional application No. 62/298,713, filed on Feb. 23, 2016.

(51) Int. Cl.

| | |
|---|---|
| ***B05D 1/04*** | (2006.01) |
| ***D06M 15/19*** | (2006.01) |
| ***B05D 1/00*** | (2006.01) |
| ***B05D 1/22*** | (2006.01) |
| ***B05D 1/28*** | (2006.01) |
| ***B05D 3/06*** | (2006.01) |
| ***B05D 3/10*** | (2006.01) |
| *D06M 101/40* | (2006.01) |

(52) U.S. Cl.

CPC ..... *D06M 15/19* (2013.01); *B05D 1/002* (2013.01); *B05D 1/007* (2013.01); *B05D 1/04* (2013.01); *B05D 1/22* (2013.01); *B05D 1/28* (2013.01); *B05D 3/065* (2013.01); *B05D 3/108* (2013.01); *D06M 2101/40* (2013.01)

(58) Field of Classification Search

CPC ..... B82Y 30/00; B82Y 40/00; C01B 32/168; C01B 32/174; Y10T 428/2918

See application file for complete search history.

(56) References Cited

U.S. PATENT DOCUMENTS

| | | | | |
|---|---|---|---|---|
| 5,370,911 | A | 12/1994 | Throne et al. | |
| 2004/0235984 | A1 | 11/2004 | Nicholl et al. | |
| 2007/0137701 | A1 | 6/2007 | Sainte Catherine et al. | |
| 2008/0170982 | A1* | 7/2008 | Zhang | C01B 32/15 423/447.3 |
| 2009/0311554 | A1* | 12/2009 | Oh | B01F 17/005 428/688 |
| 2010/0074834 | A1 | 3/2010 | Kim | |

(Continued)

OTHER PUBLICATIONS

International Search Report for International Application No. PCT/US201/19039 dated May 10, 2017.

*Primary Examiner* — Alexander M Weddle

(74) *Attorney, Agent, or Firm* — Nanocomp Technologies, Inc.; Lewis D. Craft

(57) ABSTRACT

A method for coloring a carbon nanotube (CNT) product is provided, including placing a CNT product in an electric circuit to ground the product, charging a plurality of pigment molecules with an opposite charge from the CNT product, applying a coating of the charged pigment molecules to a surface of the CNT product, and exposing the coating to a temperature sufficient to cure the coating, while allowing the coating to form a substantially conformal film on the surface of the CNT product.

16 Claims, 3 Drawing Sheets

(56) References Cited

U.S. PATENT DOCUMENTS

| | | | | |
|---|---|---|---|---|
| 2010/0255303 | A1 | 10/2010 | Wardle et al. | |
| 2012/0100203 | A1* | 4/2012 | Fang | C23C 16/04 424/443 |
| 2013/0316172 | A1* | 11/2013 | Shanov | B82Y 30/00 428/367 |
| 2015/0093523 | A1* | 4/2015 | Kissell | C09D 5/24 428/34.1 |

* cited by examiner

SYSTEMS AND METHODS FOR COLORING NANOFIBROUS MATERIALS

CROSS-REFERENCE TO RELATED APPLICATIONS

This application claims priority to and the benefit of U.S. Provisional Application No. 62/298,713, filed Feb. 23, 2016, the contents of which are incorporated herein in their entirety.

FIELD

The present invention relates to systems and methods for coloring nanofibrous materials.

BACKGROUND

Carbon nanotubes are known to have extraordinary tensile strength, including high strain to failure and relatively high tensile modulus. Carbon nanotubes may also be highly resistant to fatigue, radiation damage, and heat. To this end, the addition of carbon nanotubes to composite materials can increase tensile strength and stiffness of the composite materials.

Within the last fifteen (15) years, as the properties of carbon nanotubes have been better understood, interests in carbon nanotubes have greatly increased within and outside of the research community. One key to making use of these properties is the synthesis of nanotubes in sufficient quantities for them to be broadly deployed. For example, large quantities of carbon nanotubes may be needed if they are to be used as high strength components of composites in macroscale structures (i.e., structures having dimensions greater than 1 cm.)

Engineered nanostructured products such as flatstock (sheets, tape), fibers, yarns, or dispersions used in molding or additive manufacturing such as 3-D printed parts, composed of carbon materials, such as nanotubes, graphene, or graphite, share a common molecular structure that absorbs all colors of visible light and they all appears black. This single color limits their commercial use in the textiles, smart fabrics, consumer and commercial markets

SUMMARY

In accordance with various embodiments, a method for coloring a carbon nanotube (CNT) product is provided. The method includes placing a CNT product in an electric circuit to ground the product. The method also includes charging a plurality of pigment molecules with an opposite charge from the CNT product. The method also includes applying a coating of the charged pigment molecules to a surface of the CNT product. The method also includes exposing the coating to a temperature sufficient to cure the coating, while allowing the coating to form a substantially conformal film on the surface of the CNT product.

In some embodiments, the step of exposing the coating to heat further comprises heating the CNT product prior to the step of applying. In some embodiments, the step of exposing the coating to heat is at least partially performed simultaneous with the step of applying. In some embodiments, the step of exposing the coating to heat is performed subsequent to the step of applying.

In some embodiments, the step of exposing the coating to heat includes exposing at least one of the coating or the CNT product to one or more of convection energy, infrared energy, microwave energy, laser energy, or combinations thereof. In some embodiments, the step of exposing the coating to heat further comprises flowing electricity through at least a portion of the CNT product to resistively heat the at least a portion of the CNT product.

In some embodiments, curing the coating further comprises heating the coating to a temperature of about 150° C. or higher. In some embodiments, curing the coating further comprises heating the coating to a temperature of about 150° C. to about 400° C. In some embodiments, curing the coating further comprises heating the coating to a temperature of about 200° C. to about 250° C. In some embodiments, the pigment molecules include one or more of polymers, monomers, finely divided polymers, acrylates, acrylonitrile butadiene styrene, polyamides, polyesters, polyurethanes, fusion bonded epoxies, polyethylene, polypropylene, polyphenylene sulfide, polyphenylene oxide, polystyrene, azos, anthraquinones, quinolones, perinones, perylenes, indigoids, xathenes, phthalocyanines, methines, triarylmethanes, aminoketones, azines, or combinations thereof.

In accordance with various embodiments, a colored carbon nanotube (CNT) product is provided. The colored CNT product includes a body. The colored CNT product also includes a plurality of intermingled CNTs defining the body. The colored CNT product also includes a coating bonded to a surface of the body, the coating having a color different than a color of the body.

In some embodiments, the coating is a conformal coating. In some embodiments, the CNT product takes on the color of the coating bonded to the surface of the body. In some embodiments, the body comprises at least one of a CNT sheet or a CNT yarn. In some embodiments, the coating includes one or more of polymers, monomers, finely divided polymers, acrylates, acrylonitrile butadiene styrene, polyamides, polyesters, polyurethanes, fusion bonded epoxies, polyethylene, polypropylene, polyphenylene sulfide, polyphenylene oxide, polystyrene, azos, anthraquinones, quinolones, perinones, perylenes, indigoids, xathenes, phthalocyanines, methines, triarylmethanes, aminoketones, azines, or combinations thereof.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein.

Figure 1:
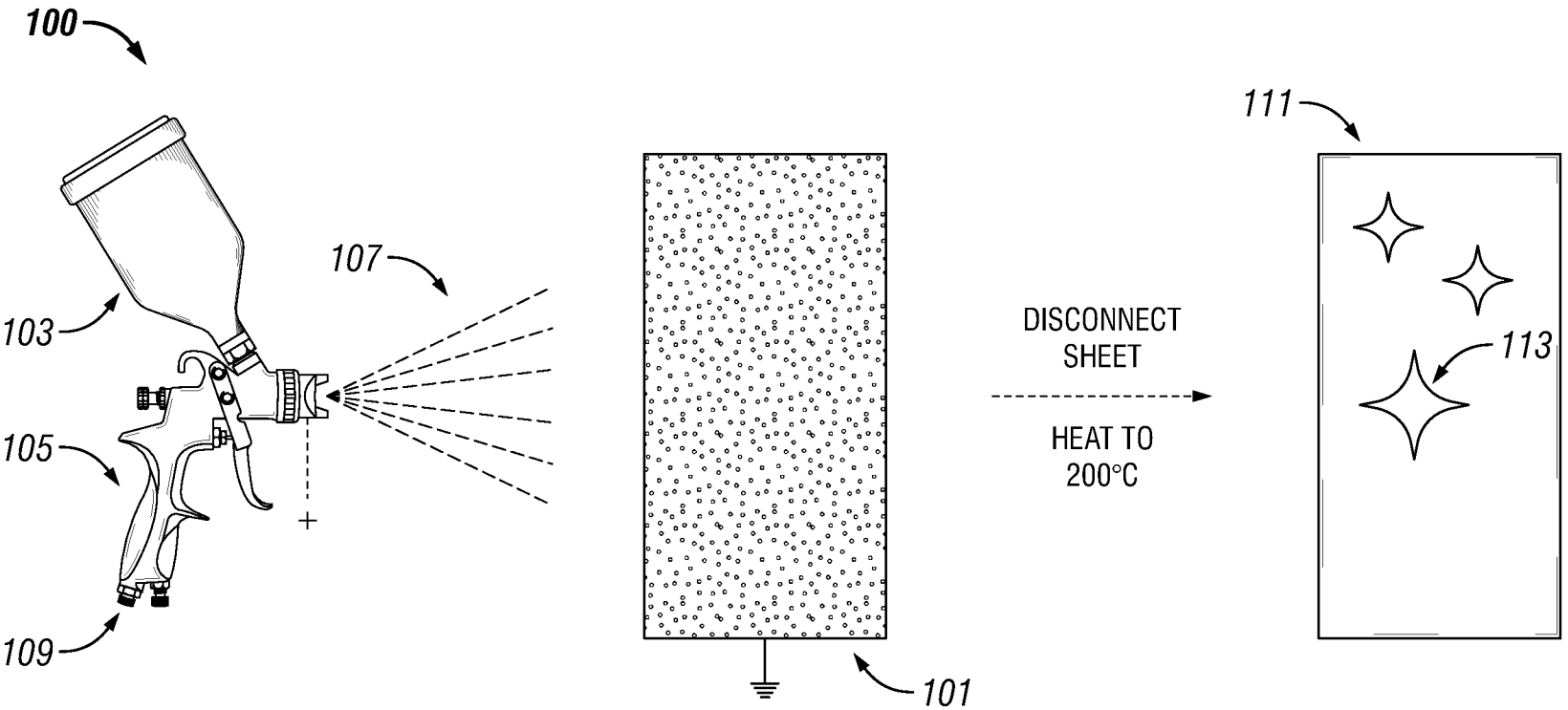
FIG. 1 illustrates an embodiment of a system and method of coloring a nanofibrous product in accordance with the present disclosure.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It being understood that various changes may be made in the function and arrangement of elements without departing from the spirit and scope of the disclosure as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the disclosure may be shown as components in block diagram form in order not to obscure the embodiments in unnecessary detail. In other instances, well-known processes, structures, and techniques may be shown without unnecessary detail in order to avoid obscuring the embodiments.

In an embodiment of the present disclosure there is provided a method for coloring a nanostructured product comprising electronically grounding a carbon nanofibrous product in an electrical circuit to yield a charged nanofibrous product, charging a plurality of pigment molecules with an opposing charge, applying the charged pigment molecules to a surface of the charged product to form a coating on the surface, and heating the coating to yield a cured coating, such that the cured coating comprises a substantially conformal film on the surface of the product. As used herein, "nanofibrous" and "nanostructured" may be used interchangeably.

In another embodiment, a method for coloring a nanostructured product may comprise applying a plurality of pigment molecules to a nanostructured product using a high pressure application system to form a coating of pigment molecules on a surface of the product, and heating the coating to cure the coating to yield a substantially conformal film on the surface of the product. In another embodiment, the pigment molecules may be attached to the nanostructured product through a chemical interaction between the pigment molecules and the nanostructured product. In some instances, the chemical interaction may be activated or mediated by EM radiation (e.g., UV light).

As used herein, a "substantially conformal film" shall mean a substantially uniform coating of molecules applied to a surface of a porous carbon nanofibrous material or engineered carbon nanofibrous product, the coating penetrating and evenly covering any microstructures on the surface of the material or product surface. These colorized nanostructured products, in some embodiments, can subsequently be used in the manufacturing of various macroscale products.

As used herein, "nanostructured product" can include carbon nanotubes, graphene or graphite. In some embodiments, the nanostructured product can include flatstock (sheets, tape), fibers, yarns, or dispersions used in molding or additive manufacturing such as 3-D printed parts.

Carbon nanotubes (CNT), in some embodiments, may be fabricated using a variety of approaches for growing nanotubes and forming yarns, sheets or cable structures made from these nanotubes. These include: (1) Chemical Vapor Deposition (CVD), a common process that can occur at near ambient or at high pressures, and at temperatures above about 400° C., (2) Arc Discharge, a high temperature process that can give rise to tubes having a high degree of perfection, and (3) Laser ablation. In general, the CNTs can be formed into a CNT sheet, CNT strip, CNT tape, bulk-collected CNTs, CNT yarns, any other suitable CNT material, product, structure, and/or combinations thereof.

In some embodiments, a CVD process or similar gas phase pyrolysis procedure known in the industry can be used to generate the appropriate nanostructures, including carbon nanotubes. Growth temperatures for a CVD process can be comparatively low ranging, for instance, from about 400° C. to about 1350° C. Carbon nanotubes (CNTs), both single wall (SWNT) or multiwall (MWNT), may be grown, in some embodiments, by exposing nanoscaled catalyst particles in the presence of reagent carbon-containing gases (i.e., gaseous carbon source). In particular, the nanoscaled catalyst particles may be introduced into the reagent carbon-containing gases, either by addition of existing particles or by in situ synthesis of the particles from a metal-organic precursor, or even non-metallic catalysts. Although both SWNT and MWNT may be grown, in certain instances, SWNT may be selected due to their relatively higher growth rate and tendency to form rope-like structures, which may offer advantages in handling, thermal conductivity, electronic properties, and strength.

The strength of the individual carbon nanotubes generated in connection with the present invention can be, for example, about 30 GPa or more. Strength, as should be noted, is sensitive to defects. However, the elastic modulus of the carbon nanotubes fabricated in the present invention may not be sensitive to defects and can vary from about 1 to about 1.2 TPa. Moreover, the strain to failure of these nanotubes, which generally can be a structure sensitive parameter, may range from a about 10% to a maximum of about 25% in the present invention.

Furthermore, the nanotubes of the present invention can be provided with relatively small diameter. In an embodiment of the present invention, the nanotubes fabricated in the present invention can be provided with a diameter in a range of from less than 1 nm to about 30 nm. It should be appreciated that the carbon nanotubes made in accordance with one embodiment of the present invention may be extended in length (i.e., long tubes) when compared to commercially available carbon nanotubes. In an embodiment of the present invention, the nanotubes fabricated in the present invention can be provided with a length in the millimeter (mm) range.

It should be noted that although reference is made throughout the application to nanotubes synthesized from carbon, other compound(s), such as boron nitride, MoS2, or a combination thereof may be used in the synthesis of nanotubes in connection with the present invention. For instance, it should be understood that boron nitride nanotubes may also be grown, but with different chemical precursors. In addition, it should be noted that boron and/or nitrogen may also be used to reduce resistivity in individual carbon nanotubes. Furthermore, other methods, such as plasma CVD or the like can also be used to fabricate the nanotubes of the present invention.

In some embodiments, the CNT material, in accordance with various embodiments, can be produced by Floating Catalyst Chemical Vapor Deposition (FC-CVD) as described in U.S. Pat. No. 8,999,285, the contents of which are incorporated herein in their entirety. The FC-CVD method of CNT production can lead to very long nanotubes (>100 microns) that become well-entangled while in the gas phase as they are being created. As the CNT material exits the hot zone of the furnace, the nanotubes entangle, bundle and otherwise coalesce into and extended network of interconnected and branching bundles that is not obtainable by other CNT production processes. In some embodiments, the extended network of interconnected CNTs produced by FC-CVD can improve electrical and mechanical properties of the CNT product.

In accordance with some embodiments, the formation of a nanofibrous product, such as yarns, may be accomplished using applicant's methods, such as those disclosed in U.S. Pat. No. 7,993,620, the entire disclosure of which is hereinafter incorporated by reference. Nanofibrous yarns may be relatively long fibrous structures capable of being employed in applications requiring length. In particular, the twisting action during formation of the yarn allows staple fibers (i.e., nanotubes) to be held together into larger fibrous structure (i.e., the yarn). Additionally, twisting of axially aligned fibers (i.e., nanotubes) can enhance load transfer between the fibers to allow for the formation of a high strength yarn. It should be noted that the colorization of commercially available yarns, or those not made by the applicant's process, can also be used in connection with the colorization process of the present invention.

Specifically, staple fibers comprising nanotubes can be provided with a high aspect ratio (e.g., >100:1 length: diameter). As a result, they can serve better than those with smaller aspect ratios to transfer structural loads between individual fibers within a yarn. The strength of the yarn can further be enhanced by increasing the bond strength between adjacent fibers. In an embodiment, the yarn may be impregnated with a matrix material, such as a polymer, or a surfactant molecule to crosslink adjacent fibers. Crosslinking the fibers using covalent or ionic chemical bonds can provide an additional means of improving the overall strength of the yarn.

In some embodiments, the nanofibrous product may comprise bulk nanomaterials of high strength in a non-woven sheet, such as those disclosed in U.S. Pat. No. 7,933,620, incorporated herein by reference. In some embodiments, the bulk nanomaterials can be processed for end use applications, including (i) structural systems, such as fabrics, armor, composite reinforcements, antennas, electrical or thermal conductors, and electrodes, (ii) mechanical structural elements, such as plates and I-beams, and (iii) cabling or ropes. Other embodiments may include hydrogen storage, batteries, or capacitor components.

In some embodiments, the non-woven sheet may be incorporated into composite structures such as sporting goods products, helmets, etc. In some embodiments, a composite material may be formed by impregnating the non-woven sheet with a matrix precursor, such as Krayton, vinyl ester, PEEK, bispolyamide, BMI (bismaleimide), epoxies, or polyamides, and subsequently allowing the matrix to polymerize or thermally cure.

In accordance with some embodiments, a layered composite of materials may be formed by sintering non-woven sheets together with a matrix material. In some embodiments, macroscale structures may be made from non-woven sheets of the present invention having aligned fibers. In another embodiment, the nanofibrous materials may be incorporated for use in anisotropic composites and thermal conductors, and especially in gratings, filters, and shields of electromagnetic radiation, or other waves, such as electrons or neutrons with wavelengths greater than, for instance, 0.1 nm.

Referring to FIG. 1, in accordance with the present disclosure there is provided a system 100 for coloring a nanofibrous sheet 101 comprising a holding device (not shown) for securing the nanofibrous sheet 101 in place for subsequent coating. In some embodiments the holding device may impart a negative charge to the sheet 101 by grounding the sheet 101 in an electric circuit. Alternatively, in some embodiments, the holding device may impart a positive charge to the sheet 101. In some embodiments, for example, the grounding of the sheet 101 in connection with an embodiment of the present invention, comprises placing the nanofibrous product into an electrical circuit which may cause a negative or positive charge to be applied to the sheet 101. However, it should be noted that any known approaches to grounding the sheet are contemplated herein.

The system 100 also includes a reservoir 103 within which a volume of the pigment molecules 107 to be applied can be accommodated. The system 100 further includes a delivery device 105, coupled to the reservoir 103, for imparting a positive charge to the pigment molecules 107 and subsequently directing the pigment molecules 107 from the reservoir 103, through the delivery device 105, and on to the surface of the sheet 101. Alternatively, in some embodiments, the delivery device 103 may impart a negative charge to the pigment molecules 107. Once the pigment molecules 107 are charged and the nanofibrous sheet 101 is grounded, the pigment molecules 107 can be applied to the nanofibrous sheet 101 to electrostatically coat the nanofibrous sheet 101 with the pigment molecules 107.

In some embodiments, carbon nanofibrous materials as discussed above can be used to form the nanofibrous sheet 101. Carbon nanofibrous materials can, in some embodiments, be well suited for electrostatic coating because the carbon nanofibrous materials can be hydrophobic, resistant to chemical attack, and possess a natural electrical conductance for charging. Therefore, in some embodiments, carbon nanofibrous materials can permit charged pigment particles to deposit onto the surface of the nanofibrous sheet 101 with enough integrity to survive handling and define the substantially conformal film 113.

In some embodiments, the delivery device 105 may comprise a gun, one or more nozzles, a sprayer, a hose, any forcible delivery system, any device or system that may forcibly direct the pigment molecules 107 on to the surface of the charged sheet 101, or combinations thereof. In some embodiments, the gun may be an electrostatic gun, a corona gun, or a tribo gun. It is further contemplated that the delivery device 105 may include any device that can direct substantially uniform coats of pigment molecules 107 as to the surface of the sheet 107. It should be appreciated that if both sides of the sheet 101 are to be colorized, the holding device may be rotated so that the other side of the sheet can be coated. Alternatively, the delivery device 105 may be moved to the non-coated side of the sheet 101 and the pigment molecules 107 applied thereto. In some embodiments, the pigment molecules 107 may be applied to the nanofibrous sheet 101 using, for example, one or more single point nozzles or electrostatic discs. Electrostatic discs, in some embodiments, include a circular disk for emitting the pigment molecules 107.

In accordance with some embodiments, to facilitate the directing of the pigment molecules 107 from the delivery device 105, a high pressure system can be used to enhance performance of the delivery device 105. For example, in some embodiments, a carrier gas 109 can be used. To that end, by directing the carrier gas 109 into the delivery device 105 while the pigment molecules 107 is simultaneously entering the delivery device 105 from the reservoir 103, the carrier gas 109 may act to direct the pigment molecules 107 from the delivery device 105 and on to the surface of the nanofibrous sheet 101.

It will be apparent in view of this disclosure that, while the embodiment shown in FIG. 1 is described and illustrated wherein the pigment molecules 107 are applied directly by the delivery device, in some embodiments, the charged pigment molecules 107 can be applied, for example, by dipping the materials into a liquid reservoir of the coating, or by brushing the coating on to the surface, e.g. brushing with an electromagnetic brush or an electromagnetic roller. In some embodiments, an electrostatic fluidized bed that passes grounded conductive nanofibrous materials through a charged pigment cloud may be used to apply the pigment molecules.

In some embodiments, the pigment molecules 107, for use in coloring the nanofibrous product 101, in accordance with various embodiments, may comprise a polymer, a monomer, or a finely divided polymer. In some embodiments, the polymer may be selected from acrylates, acrylonitrile butadiene styrene, polyamides, polyesters, polyurethanes, fusion bonded epoxies, polyethylene, polypropylene, polyphenylene sulfide, polyphenylene oxide, and polystyrene. In some embodiments, the pigment or dye may be any chromophore (coloring agent) from a chemical class which can be introduced into the polymer. For instance, chemical classes of coloring agents for polymers may include azos, anthraquinones, quinolones, perinones, perylenes, indigoids, xathenes, phthalocyanines, methines, triarylmethanes, aminoketones, and azines. In accordance with some embodiments, the pigment molecules 107 may be positively charged prior to being applied on to the nanofibrous product 101. By doing so, a charge may be imparted to the plurality of pigment molecules 107, allowing the pigment molecules 107 to better adhere to the surface of the nanofibrous product/material 101. The pigment molecules 107, in accordance with various embodiments can have a size of about 0.255 microns to about 1,408 microns, for example, about 10 microns to about 250 microns.

The system of FIG. 1 can further include a heat source (not shown) capable of heating the pigment molecules 107 after its application onto the surface of the sheet 101 to yield a cured sheet 111. For example, in some embodiments, the nanofibrous sheet 101, after being electrostatically coated with pigment molecules 107 can be placed in or moved through a curing oven. Alternatively, in some embodiments (not shown) electric current can be passed through the nanofibrous sheet 101 to heat it directly, advantageously avoiding a need to cure the pigment molecules 107 onto the nanofibrous sheet 101 in an external heating enclosure. In some embodiments, the pigment molecules 107 can be cured onto the nanofibrous sheet 101 at a temperature of about 200° C. (390° F.) or more for about two minutes or more. However, it will be apparent in view of this disclosure that cure temperature can be more or less than about 200° C. (390° F.) and that cure time can be more or less than about two minutes and, in fact, that any suitable combination of cure temperature and cure time can be used as appropriate to cure any particular combination of pigment molecules 107 and nanofibrous sheets 101. Advantageously, 200° C. (390° F.) is less than a combustion temperature of the nanofibrous sheet 101, which in some embodiments can be, for example, about 500° C. (930° F.). In some embodiments, the temperature of the pigment molecules 107 on the surface of the nanofibrous sheet 101 can be measured during curing directly using a device such as a thermocouple or thermal imaging camera or can be measured indirectly by measuring an ambient temperature of the heating enclosure or curing oven.

In curing the layer or film of pigment molecules 107 applied to the sheet 101, a substantially conformal film 113 of the pigment molecules 107 can be provided on the surface of the cured sheet 111. The heat source, in an embodiment, may be any source of heat energy which may cure the pigment molecules 107 to form a substantially conformal film 113 of the pigment molecules 107 on the surface. In some embodiments, to expose the pigment molecules 107 to a heat source, the sheet 101 may be disconnected from the holding device in order to be placed within the heat source at a desired cure temperature for a desired cure time as described hereinabove.

Additionally, although the embodiment shown in FIG. 1 provides heating of the nanofibrous sheet 101 and the pigment molecules 107 after application of the pigment molecules 107 to the surface, it will be apparent that, as described in greater detail below with reference to FIG. 3, either of the nanofibrous sheet 101 and the pigment molecules 107 can be heated alone or in combination at any time including before, during, and after application of the pigment molecules 107 to the surface of the sheet 101.

It should be noted that, although the nanofibrous sheet 101 is shown and described in FIG. 1 as being colorized to form the cured sheet 111 in a batch approach, it will be apparent in accordance with various embodiments that the nanofibrous sheet 101 or sheets can be colorized a continuous manner where, for example, a roll of the sheet 101 can be run through the system 100 similar to the spool method described below with reference to FIG. 2 or wherein the system 100 is configured as a moving assembly line such that a plurality of nanofibrous sheets 101 can be individually colorized in a continuous, moving process.

Figure 2:
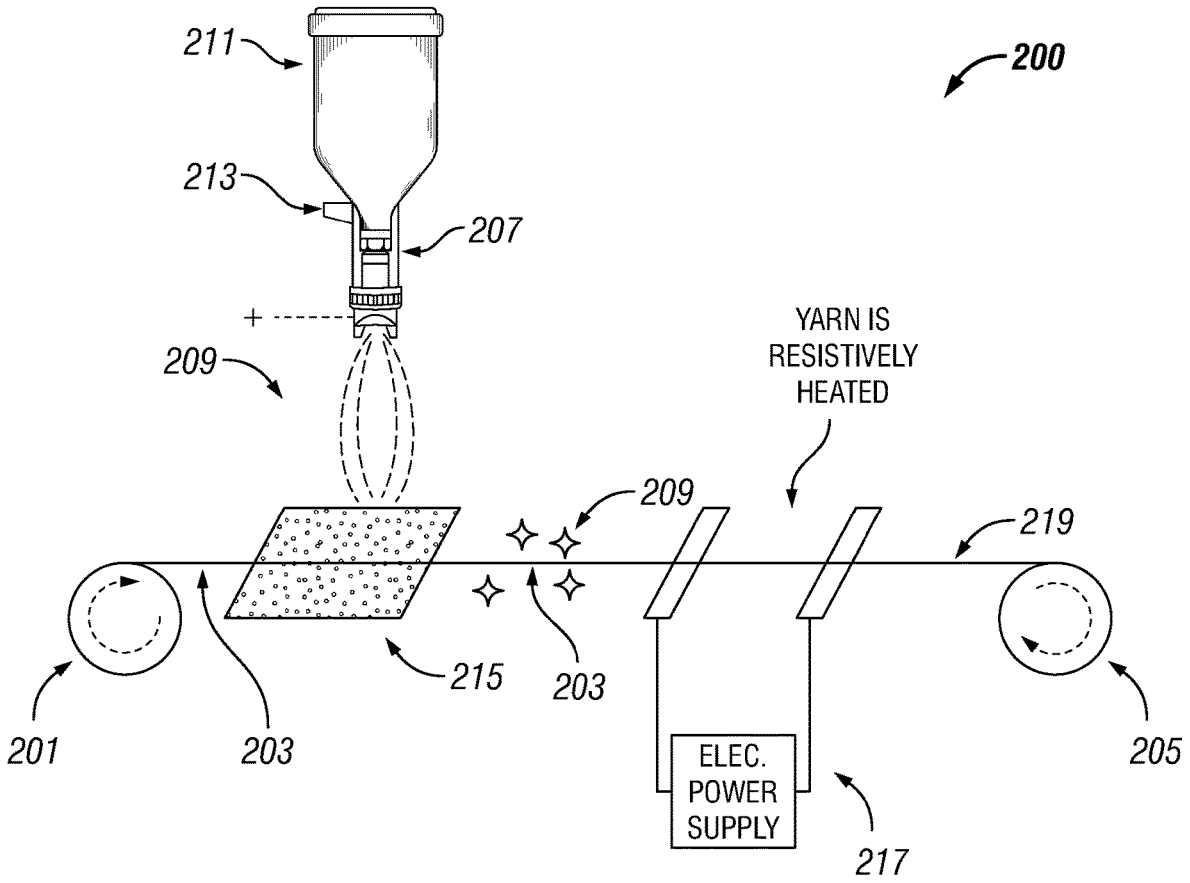
FIG. 2 illustrates an embodiment of a system and method of coloring nanofibrous materials in accordance with the present disclosure.

Referring now to FIG. 2, in accordance with the present disclosure there is provided a system 200 for continuously coloring a nanofibrous yarn. The system 200, in some embodiments, includes at one end, a source 201 of nanofibrous yarn 203, for example, from a supply spool for supplying the yarn, and at an opposing end, a take-up spool 205 for collecting the yarn 203 to continuously move the yarn 203 through the system 200. The system 200 can also include a delivery device 207 for applying a coating of a pigment molecules 209 to the yarn 203. In some embodiments, the delivery device 207 includes a reservoir 211 within which a volume of pigment molecules 209 can be accommodated. In one embodiment, the delivery device 207 can be designed to impart a positive charge to the pigment molecules 209 and to subsequently direct the pigment molecules 209 on to the surface of the yarn 203 between the spools 201, 205. Alternatively, in some embodiments, the delivery device 207 may impart a negative charge to the pigment molecules 209. To direct the polymer from the delivery device 207 and on to the yarn 203, a carrier gas 213 may be used. In some embodiments, the delivery device 207 may comprise a gun, one or more nozzles, a sprayer or a hose. In some embodiments, the gun may be an electrostatic gun, a corona gun, or a tribo gun. It is further contemplated that the delivery device 207 may include any device that can direct substantially uniform coats of pigment molecules 209 on to the surface of the yarn 203.

The system of FIG. 2 can further include a conductive plate 215 to ground the yarn 203, by imparting a negative charge to the yarn 203. Alternatively, in some embodiments, the conductive plate 215 may impart a positive charge to the yarn 203. The conductive plate 215, in some embodiments, may be made from any conductive material. In some embodiments, the conductive plate 215 may have a surface area sufficiently large to allow the yarn 203 to contact the conductive plate 215 to ground the yarn 203. It should be appreciated that if the yarn 203 is to be circumferentially coated, an additional delivery device or devices may be provided or that the yarn 203 may need to be looped back to be sprayed by the delivery device 207 prior to curing of the pigment molecules 209.

To cure the pigment molecules 209 on the yarn 203, the system 200 can be provided with, in some embodiments, a resistive heating mechanism 217 positioned in-line with the spools 201, 205 and between the conductive plate 215 and the take-up spool 205 to resistively heat the pigment molecules 209 on the yarn 203 to yield a cured yarn 219. In some embodiments the resistive heating mechanism 217 can deliver, for example, about one (1) milliampere or more of current to a segment of the yarn 203 as electrostatically coated with pigment molecules 209 to resistively heat the segment. In some embodiments, the pigment molecules 209 can be cured onto the nanofibrous yarn 203 at a surface temperature of about 200° C. (390° F.) or more for about two minutes or more. However, it will be apparent in view of this disclosure that cure temperature can be more or less than about 200° C. (390° F.) and that cure time can be more or less than about two minutes and, in fact, that any suitable combination of cure temperature and cure time can be used as appropriate to cure any particular combination of pigment molecules 209 and nanofibrous yarns 203. It will be apparent in view of this disclosure that, in accordance with various embodiments, the resistive heating mechanism can deliver any current to a segment of the yarn 203 of any suitable length moving at any suitable travel rate of the yarn 203 can be used as appropriate in order to achieve a proper cure for any particular combination of pigment molecules 209 and nanofibrous yarns 203. For example, in some embodiments, the resistively heated segment of the yarn 203 can be about 25 cm (12 inches) or less and travel at a rate of about 0.125 m/s or less. In some embodiments, the temperature of the pigment molecules 209 on the surface of the nanofibrous sheet 203 can be measured during curing directly using a device such as a thermocouple or thermal imaging camera.

The cured yarn 219, similar to the cured sheet 111 of the embodiment described above with reference to FIG. 1, is provided with a substantially conformal film of the pigment molecules 209 on its surface. Additionally, although the embodiment shown in FIG. 2 results in heating of the yarn 203 after application of the pigment molecules 209 to the surface, it will be apparent that, as described in greater detail below with reference to FIG. 3, either of the nanofibrous yarn 203 and the pigment molecules 209 can be heated alone or in combination at any time including before, during, and after application of the pigment molecules 209 to the surface of the yarn 203.

It should be noted that, although the nanofibrous yarn is shown and described in FIG. 2 as being colorized to form the cured yarn 219 in a continuous spooled approach, it will be apparent in accordance with various embodiments that the nanofibrous yarn 203 can be colorized a continuous manner where, for example, the system 200 is configured as a moving assembly line such that a plurality of lengths of the yarn 203 can be individually colorized in a continuous, moving process. Alternatively, in some embodiments, lengths of the yarn 203 can be individually colorized in a batch process as described above with reference to FIG. 1.

Figure 3:
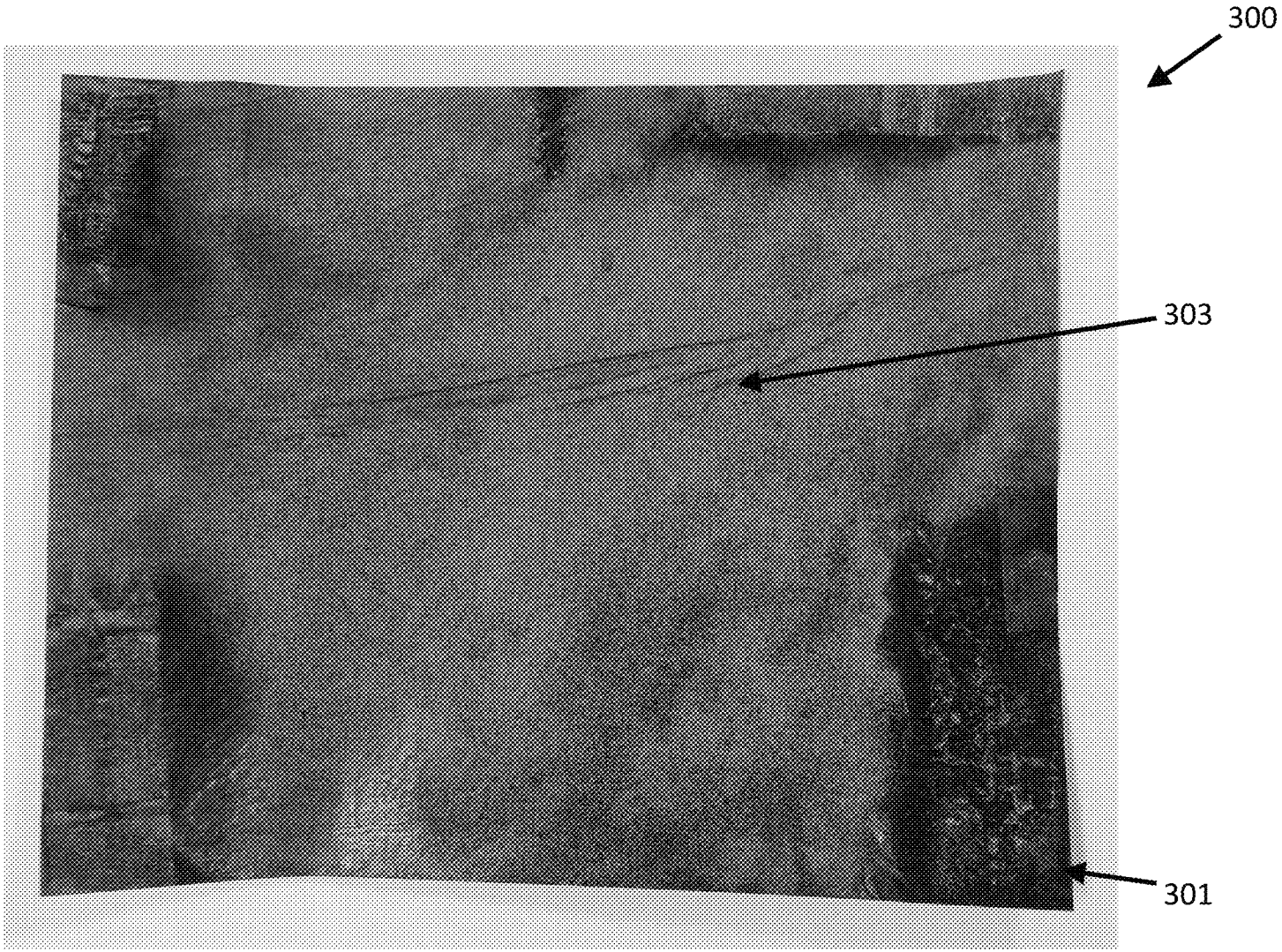
FIG. 3 depicts a coated layer of pigment molecules on a surface of a nanostructured product in accordance with the present disclosure.

Referring now to FIG. 3, a colorized product 300 can include a nanofibrous product 101 coated with a substantially conformal film of pigment molecules (e.g., pigment molecules 107 and 209 as described above with reference to FIGS. 1 and 2). In some embodiments, heating one or both of the nanofibrous product 301 or the pigment molecules before, during, or after coating may allow for the formation of the substantially conformal film 303 on the surface of the nanofibrous materials of the nanofibrous product 301. In some embodiments, to ensure the integrity of the coating, the pigment molecules on the surface of the product 301 and/or the product 301 itself can be exposed to heat after the pigment molecules is deposited onto or applied to the surface to cure the coating 303 and improve the integrity of the coating 303. In some embodiments, the nanofibrous product 301 can be heated prior to, during, and/or after application of the pigment molecules such that, for example, the pigment molecules are at least partially heated and cured by contact heat transfer from the nanofibrous product 301 to the pigment molecules. In some embodiments, the pigment molecules can be directly heated before (e.g., for melting into a liquid form for dipping of the nanofibrous product 301 therein), during, or after application to the nanofibrous product 301. Alternatively, in some embodiments, both the pigment molecules and the nanofibrous product 301 can be heated, whether simultaneously or at different stages of processing. For example, in some embodiments, both the pigment molecules and the nanofibrous product 301 can be heated in a curing oven after application of the pigment molecules to the nanofibrous product 301 to cure the pigment molecules and form the conformal coating 303. In some embodiments, the nanofibrous product can be preheated in a curing oven before application of the pigment molecules and, after application of the pigment molecules, the pigment molecules can be heated and cured by exposure to laser energy. However, it will be appreciated in view of this disclosure that any method of heating the pigment molecules at least one of before, during, or after application of the pigment molecules to the nanofibrous product 301, any method of heating the nanofibrous product 301 at least one of before, during, or after application of the pigment molecules to the nanofibrous product 301, or any combination thereof can be used in accordance with various embodiments.

In accordance with various embodiments, any suitable method of heating the pigment molecules and/or the nanofibrous product 301 can be used before, during, or after application of the pigment molecules to the nanofibrous product. Heating methods, in accordance with various embodiments, can include, for example, one or more of resistive heating (e.g., by in situ application of electrical power to the nanofibrous product 301), convection energy heating, infrared energy heating, microwave energy heating, laser energy heating, any other suitable heating method, or combinations thereof. In some embodiments, in order to form and cure the conformal coating 303, the pigment molecules, whether directly exposed to heat or indirectly heated by heat transfer from the heated nanofibrous product 301, can, for example, be heated to a cure temperature of about 150° C. or higher. In some embodiments, the pigment molecules can, for example, be directly or indirectly heated to a cure temperature of about 150° C. to about 400° C. In some embodiments, the pigment molecules can, for example, be directly or indirectly heated to a cure temperature of about 200° C. to about 250° C. In some embodiments, in order to form and cure the conformal coating 303, the pigment molecules can be heated to the cure temperature for at least about 10 minutes. For example, in some embodiments the pigment molecules can be heated to the cure temperature for about 1 minute to about 60 minutes.

EXAMPLES

Example 1

An electrically grounded nanofibrous product, i.e., a carbon nanotube (CNT) sheet, having a negative charge as a result of the grounding, was coated with a substantially conformal layer of powder of a charged pigment using a spray mechanism. The spray mechanism was positively charged to impart a positive charge to the polymer. The coated sheet was then heated in order to cure the layer of polymer thereon and to provide it with a conformal film on the sheet. The heating was done by placing the coated product in an oven (other sources of infra-red radiation may be used) at a temperature of between 150° C. and 200° C. The conformal film adhesion on the sheet is resistant to removal by routine handling or scratching.

Example 2

An electrically grounded nanofibrous product, i.e., a carbon nanotube (CNT) yarn, was coated with a substantially conformal layer of powder of a charged pigment using a spray mechanism. The spray mechanism was positively charged to impart a positive charge to the polymer, and the yarn was passed over a conductive plate located directly beneath the spray mechanism so as to impart a negative charge to the yarn. The coated yarn was then heated in order to cure the layer of polymer thereon and to provide it with a conformal film on the yarn. The heating was done by exposing the coated yarn to resistive heat (other sources of heat may be used) at a temperature of between 150° C. and 200° C. The conformal film adhesion on the yarn is resistant to removal by routine handling or scratching.

Whereas many alterations and modifications of the present disclosure will no doubt become apparent to a person of ordinary skill in the art after having read the foregoing description, it is to be understood that the particular embodiments shown and described by way of illustration are in no way intended to be considered limiting. Further, the disclosure has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure. While the present disclosure has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A method for coloring a carbon nanotube (CNT) product comprising:

placing a CNT product in an electric circuit to ground the product;

charging a plurality of pigment molecules with an opposite charge from the CNT product;

applying a powder coating of the charged pigment molecules to a surface of the CNT product; and exposing the charged pigment molecules to a temperature sufficient to cure the coating, while allowing the coating to form a substantially conformal film on the surface of the CNT product wherein the coated CNT product comprises an extended network of interconnected and branching bundles of nanotubes.

2. The method of claim 1, wherein the step of exposing the charged pigment molecules to heat is performed subsequent to the step of applying.

3. The method of claim 1, wherein the step of exposing the charged pigment molecules to heat is at least partially performed simultaneous with the step of applying.

4. The method of claim 1, wherein curing the coating further comprises heating the coating to a temperature of about 150° C. or higher.

5. The method of claim 4, wherein curing the coating further comprises heating the coating to a temperature of about 150° C. to about 400° C.

6. The method of claim 5, wherein curing the coating further comprises heating the coating to a temperature of about 200° C. to about 250° C.

7. The method of claim 1, wherein the pigment molecules include one or more of polymers, monomers, finely divided polymers, acrylates, acrylonitrile butadiene styrene, polyamides, polyesters, polyurethanes, fusion bonded epoxies, polyethylene, polypropylene, polyphenylene sulfide, polyphenylene oxide, polystyrene, azos, anthraquinones, quinolones, perinones, perylenes, indigoids, xanthenes, phthalocyanines, methines, triarylmethanes, aminoketones, azines, or combinations thereof.

8. The method of claim 1, wherein the step of exposing the coating to heat includes exposing at least one of the coating or the CNT product to one or more of convection energy, infrared energy, microwave energy, laser energy, or combinations thereof.

9. The method of claim 1, wherein the step of exposing the coating to heat further comprises flowing electricity through at least a portion of the CNT product to resistively heat the at least a portion of the CNT product.

10. The method of claim 1, wherein the CNT product is in the form of a CNT sheet, CNT strip, CNT tape, bulk-collected CNTs, or CNT yarn.

11. A method for coloring a carbon nanotube (CNT) product comprising:

heating a CNT product;

placing the CNT product in an electric circuit to ground the product;

charging a plurality of pigment molecules with an opposite charge from the CNT product;

applying a powder coating of the charged pigment molecules to a surface of the CNT product, wherein contact between the heated CNT product and the charged pigment molecules of the coating heats the coating to a temperature sufficient to cure the coating, while allowing the coating to form a substantially conformal film on the surface of the CNT product wherein the coated CNT product comprises an extended network of interconnected and branching bundles of nanotubes.

12. The method of claim 11, wherein curing the coating further comprises heating the coating to a temperature of about 150° C. or higher.

13. The method of claim 11, wherein the pigment molecules include one or more of polymers, monomers, finely divided polymers, acrylates, acrylonitrile butadiene styrene, polyamides, polyesters, polyurethanes, fusion bonded epoxies, polyethylene, polypropylene, polyphenylene sulfide, polyphenylene oxide, polystyrene, azos, anthraquinones, quinolones, perinones, perylenes, indigoids, xanthenes, phthalocyanines, methines, triarylmethanes, aminoketones, azines, or combinations thereof.

14. The method of claim 11, wherein the step of heating the CNT product includes exposing the CNT product to one or more of convection energy, infrared energy, microwave energy, laser energy, or combinations thereof.

15. The method of claim 11, wherein the step of heating the CNT product further comprises flowing electricity through at least a portion of the CNT product to resistively heat the at least a portion of the CNT product.

16. The method of claim 11, wherein the CNT product is in the form of a CNT sheet, CNT strip, CNT tape, bulk-collected CNTs, or CNT yarn.

* * * * *